US006567995B1

(12) United States Patent
Holt et al.

(10) Patent No.: US 6,567,995 B1
(45) Date of Patent: May 27, 2003

(54) TOILET SEAT LIFTING AND LOWERING DEVICE

(76) Inventors: Margaret Holt, 487 Carlton Ave., Brooklyn, NY (US) 11238; Jerriette Holt, 77 Sullivan Pl., Brooklyn, NY (US) 11225

( * ) Notice: Subject to any disclaimer, the term of this patent is extended or adjusted under 35 U.S.C. 154(b) by 0 days.

(21) Appl. No.: 10/179,833

(22) Filed: Jun. 24, 2002

(51) Int. Cl.[7] ..... A47K 13/10
(52) U.S. Cl. ..... 4/246.1
(58) Field of Search ..... 4/246.1

(56) References Cited

U.S. PATENT DOCUMENTS 2,117,663 A * 5/1938 Hill ..... 4/246.3
5,311,619 A * 5/1994 Ward ..... 4/246.1
5,754,985 A * 5/1998 Dias ..... 4/246.1
6,138,288 A * 10/2000 Archibald ..... 4/246.1
6,233,751 B1 * 5/2001 Ford ..... 4/246.5
6,305,032 B1 * 10/2001 Jones ..... 4/246.1

* cited by examiner

*Primary Examiner*—Charles E. Phillips
(74) *Attorney, Agent, or Firm*—Goldstein & Lavas, P.C

(57) ABSTRACT

A toilet seat lifting device that allows a user to lift or lower a toilet seat without have to touch the seat with his or her hands. The device has a rope assembly: and a wall mounted plate assembly. The rope assembly extends from the toilet seat to the plate assembly, and controls positioning of the seat. The rope assembly includes an elongated piece of rope having two ends, a loop between the ends, and a pair of clamps se curable to the toilet seat. Each rope end is attached to one of the clamps. The plate assembly has an elongated base, a top hook, a bottom hook, and U-shaped guides. In order to lower the toilet seat, the rope loop is extended upward towards the top hook, under the guides. To lift the seat, the loop is pulled downward over the top surface of the guide toward the bottom hook. To maintain the seat in the lifted position, the loop is secured around the bottom hook.

7 Claims, 3 Drawing Sheets

TOILET SEAT LIFTING AND LOWERING DEVICE

BACKGROUND OF THE INVENTION

The invention relates to a toilet seat lifting and lowering device. In particular, the invention has a rope assembly that allows a user to lift and lower the toilet seat without having to actually touch the seat itself.

It is necessary for men to raise the toilet seat when urinating. However, most men forget to lower the seat again, thus leaving the task for the female who follows. Because of the fear of spreading bacteria and germs, people are often hesitant to touch the toilet seat. Thus, there exists a need for a device which would allow a person to lift or lower the seat without actually touching the seat itself. Such a device would maintain the seat in the desired position until it is clear to lower the seat.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved toilet seat lifting and lowering device. As such, the general purpose of the present invention, which will be described subsequently in greater detail, is to provide a new and improved toilet seat lifting and lowering device which has all the advantages of the prior art and none of the disadvantages.

To attain this, the present invention essentially comprises a toilet seat lifting and lowering device that allows a user to lift or lower a toilet seat without having to touch the seat with his or her hands. The device has a rope assembly and a plate assembly. The plate assembly is mounted to the wall immediately above the toilet. The rope assembly extends from the toilet seat to the plate assembly, and controls positioning of the seat. The rope assembly includes an elongated piece of rope having two ends and a loop opposite the ends, and a pair of clamps secured to the toilet seat. Each rope end is secured to one of the clamps. The plate assembly has an elongated base, a top hook, a bottom hook, and at least one U-shaped guide. In order to lower the toilet seat, the rope loop is extended upward towards the top hook, under the guides, and is looped over the top hook to maintain the toilet seat in the lower position. To lift the seat, the loop is released from the top hook and pulled down over the top surface of the guides toward the bottom hook. To maintain the seat in the lifted position the loop is looped around the bottom hook.

It is an object of the invention to produce a toilet seat lifting and lowering device that allows a user to change the positioning of the toilet seat without having to touch the seat with his or her hands. Accordingly, the device comprises a rope assembly whereas the user need only touch the rope assembly to raise and lower the seat.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 2:
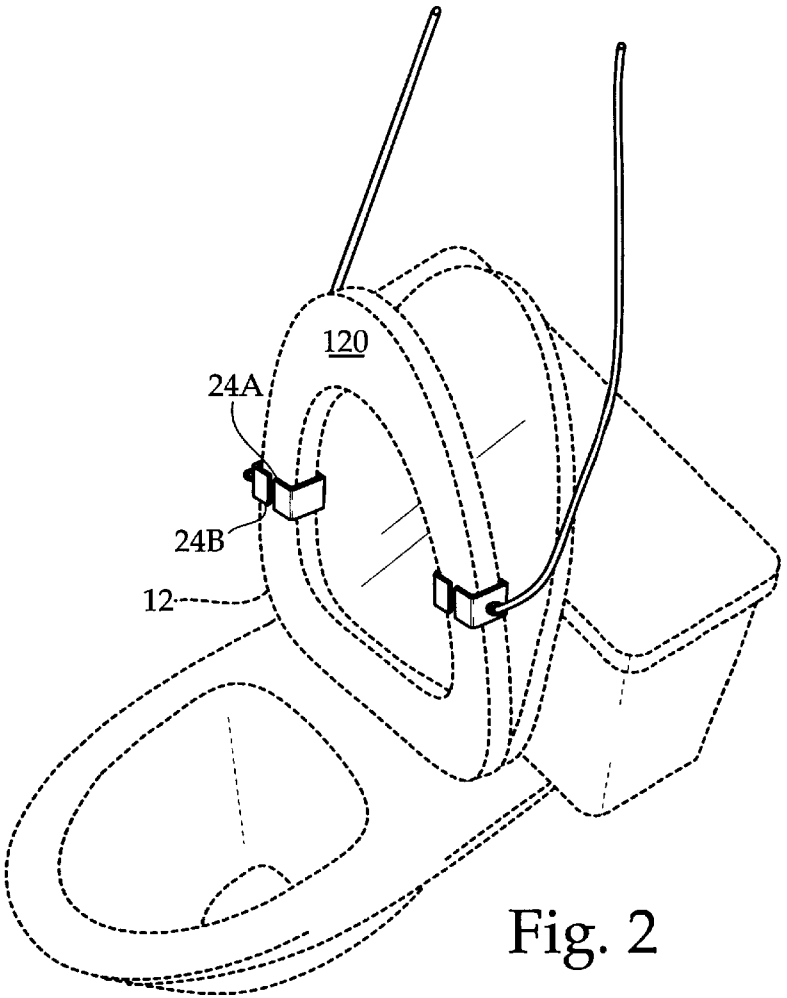
FIG. 2 is a perspective view of the rope assembly attached to the toilet seat in the lifted position.
Figure 1:
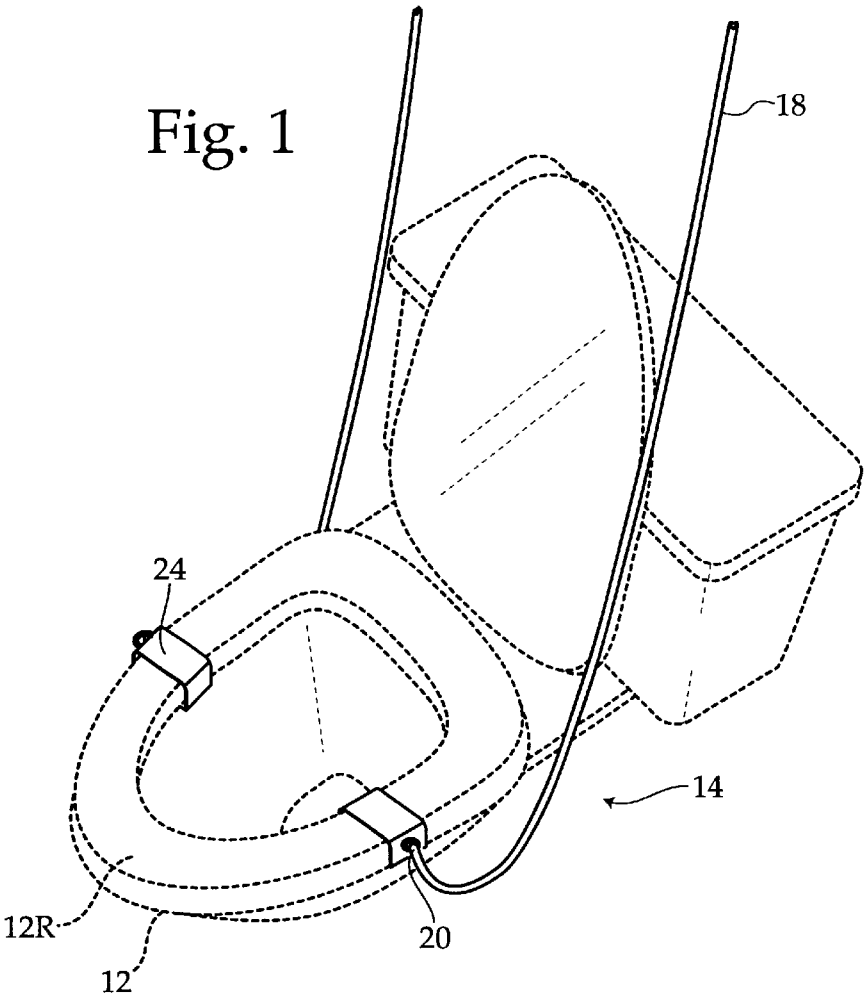
FIG. 1 is a perspective view of a rope assembly attached to a toilet seat in the lowered position.

FIGS. 1–6 illustrate a toilet seat lifting and lowering device 10 used in conjunction with a toilet 11 having a toilet seat, which allows a user to lift or lower a toilet seat 12 without have to touch the toilet seat 12 with his or her hands. The toilet seat 12 comprises a ring 12R having a top surface 12T and a bottom surface 12U. The device 10 essentially comprises a rope assembly 14 and a plate assembly 16, wherein the rope assembly 14 extends from the toilet seat 12 to the plate assembly 16, and controls positioning of the seat 12.

The plate assembly 16 comprises an elongated base 26, a pair of hooks 28, 30, and a plurality of U-shaped guides 32. The base 26 has a front surface 26F, a rear surface 26R, a top end 26T and a bottom end 26B. The plate assembly 16 is mounted above the toilet 11, with the base rear surface 26R flush against the wall. The hooks, namely a top hook 28 and a bottom hook 30, are mounted on the base front surface 26F, wherein the top hook 28 is positioned at the base top end 26T and the bottom hook 30 is positioned at the base bottom end 26B. The top hook 28 is oriented upward, while the bottom hook 30 is oriented downward.

The rope assembly 14 comprises an elongated piece of rope 18 having two ends 20, a loop 21 formed between the ends 20, and a pair of clamps 24 wherein each clamp 24 is secured to one of the ends 20. Each clamp 24 secured to the toilet seat 12 on opposite sides thereof. Each clamp 24 is C-shaped, having a clamp top surface 24T, clamp sides 24S, having a pair of clamp ends 24A and an opening 24B between the clamp ends 24A and opposite from the clamp top surface 24T. The clamp 24 is preferably constructed from a flexible plastic material to allow it to flex to expand the opening 24B such that said opening 24B is large enough to extend around the toilet seat and then closes around the toilet seat. When the clamp 24 is attached onto the toilet seat ring 12R, such that the clamp 24 extends around the toilet seat ring 12R, the ends 24A rest against and below the toilet seat bottom surface 12U and the clamp top surface 24T sits above the toilet seat ring 12R. The clamps 24 are preferably positioned on opposite sides of the toilet seat 12 in order to allow said seat 12 to be easily raised with minimal effort. Each rope end 20 is secured to one of the clamps 24 at one of the clamp sides 24S. It should be noted that the rope need not be a rope, in the traditional sense, it can also be a flexible wire, cord, bungee, or any other elongated flexible member having similar properties as a rope and capable of carrying out the functionality described herein.

The U-shaped guides 32 extend horizontally across the base front surface 26F and are secured thereto, said guides 32 are positioned between the top hook 28 and the bottom hook 30. Each guides 32 has a guide top 32T ,an inside 32U, and an outside 32A, wherein a space is created by the shape of the guide between the guide inside 32U and the base top surface 26T.

Figure 4:
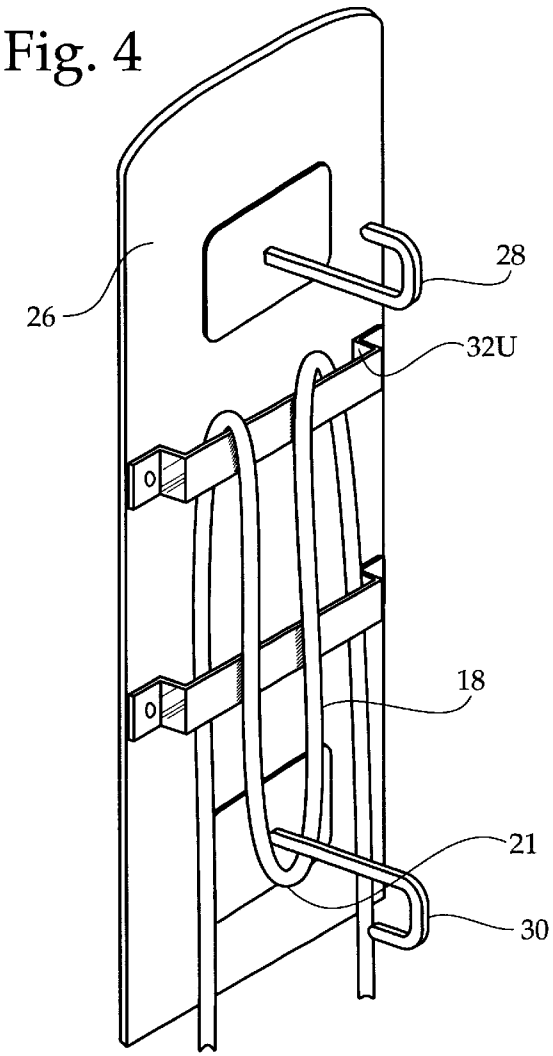
FIG. 4 is a perspective view of the plate assembly, with the rope assembly pulled downward over the top bracket so that the toilet seat in the lifted position, and wherein the rope assembly is looped around the bottom hook to maintain the toilet seat in the lifted position.
Figure 3:
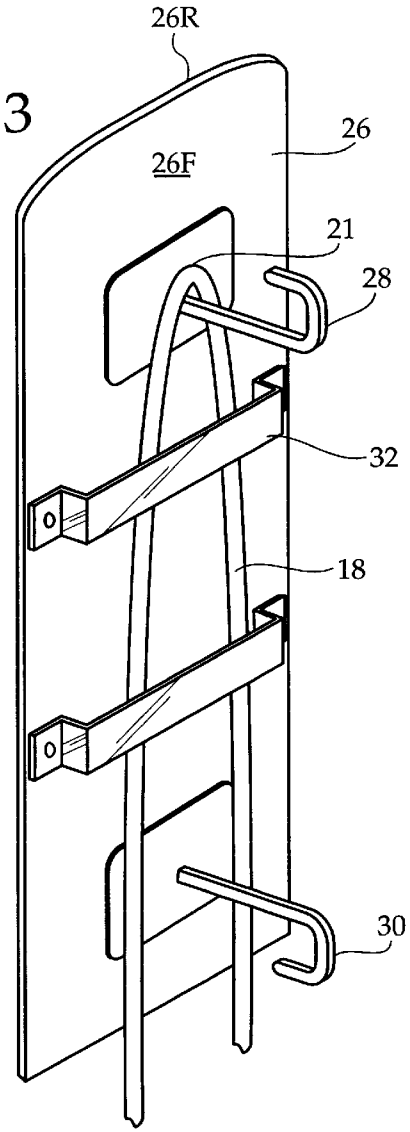
FIG. 3 is a perspective view of the plate assembly, with the rope looped over the top hook so that the toilet seat is in the lowered position.
Figure 6:
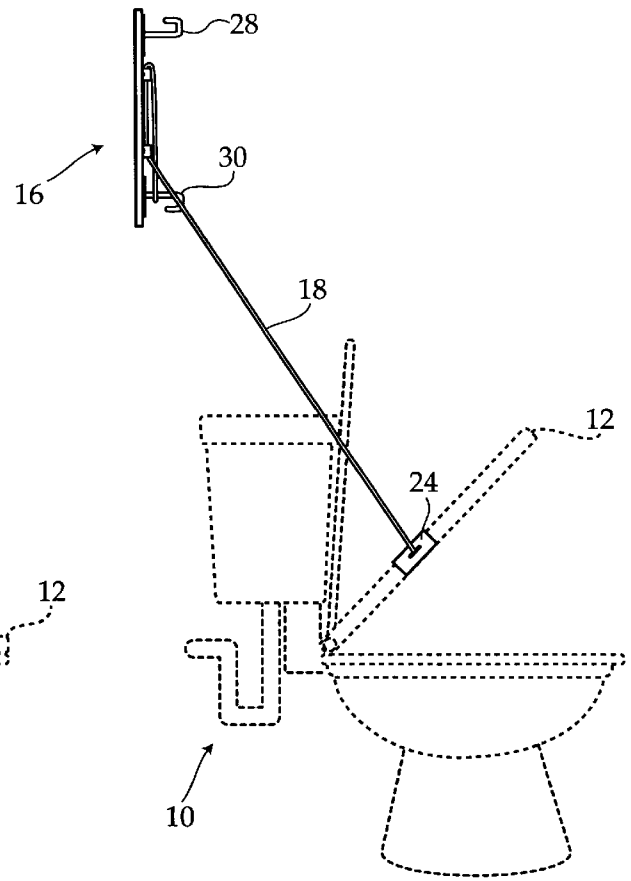
FIG. 6 is a side elevational view of the toilet seat lifting and lowering device with the toilet seat in the lifted position.
Figure 5:
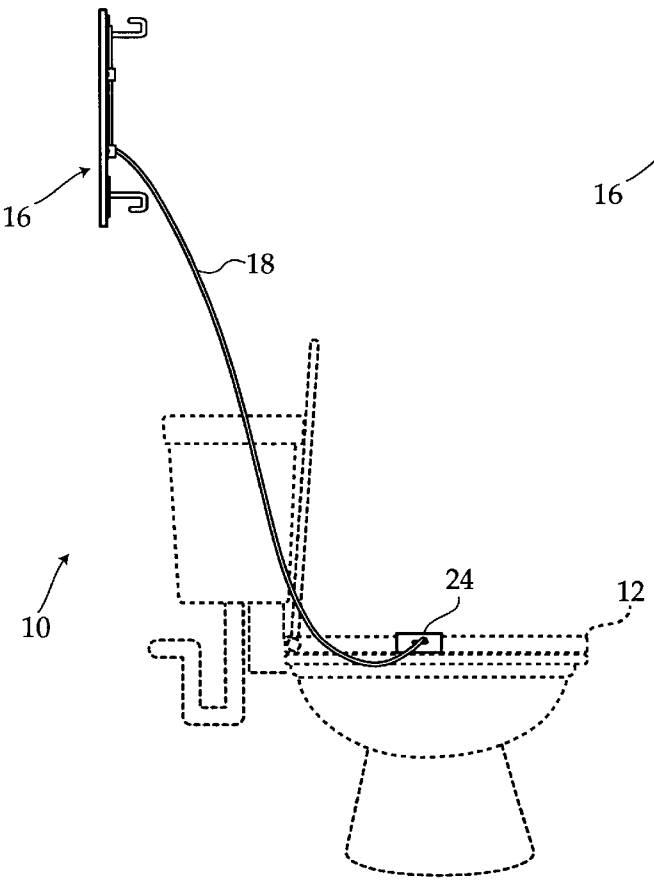
FIG. 5 is a side elevational view of the toilet seat lifting and lowering device with the toilet seat in the lowered position.

In use, the clamps 24 are attached to the toilet seat ring 12R, and the rope ends 20 are secured to the clamps 24 at one of the sides 24S of each clamp such that the rope ends 20 are secured at opposite sides of the toilet seat. The rope loop 21 is extended upward towards the plate assembly 16. The loop 21 is threaded under both guides 32, and secured over the top hook 28, as illustrated in FIG. 3. In order to raise the toilet seat 12, the rope loop 21 is unhooked from the top hook 28 and pulled downward over the top 32T of the guides 32, as illustrated in FIG. 4, the rope extending along the outside 32A of the guides. Stretching the rope 18 over the guides 32 serves to tension the rope 18, causing the toilet seat 12 to rise upward. The rope 18 is then looped around the bottom hook 30 to hold the toilet 12 in the upward position. To lower the toilet seat 12 again, the rope loop 21 is unhooked from the bottom hook 30, allowing the rope to slacken and the rope loop is attached to the top hook 28 for storage. The length of the rope 18 should be adjusted accordingly to the distance from the toilet seat 12 to the plate assembly 16 to ensure that movement of the loop 21 from the top hook to the bottom hook is sufficient to tension the rope and raise the toilet seat sufficiently.

In conclusion, herein is presented a toilet seat lifting device which allows a toilet seat to be lifted without actually touching the seat. The invention is illustrated by example in the drawing figures, and throughout the written description. It should be understood that numerous variations are possible, while adhering to the inventive concept. Such variations are contemplated as being a part of the present invention.

REFERENCE NUMERALS

10 toilet seat lifting and lowering device
11 toilet
12 toilet seat
12R toilet seat ring
12T toilet seat top surface
12U toilet seat bottom surface
14 rope assembly
16 plate assembly
20 rope
21 rope loop
22 rope end
24 clamp
24A clamp end
24B clamp opening
24T clamp top
24S clamp side
26 base
26F base front surface
26R base rear surface
26T base top end
26B base bottom end
28 top hook
30 bottom hook
32 guide
32T guide top
32A guide outside
32U guide inside

What is claimed is:

1. A toilet seat lifting device for use with toilet having a toilet seat, the toilet seat having a ring having a top surface and a bottom surface, comprising:

a plate assembly, the plate assembly for mounting above the toilet, said plate assembly comprising an elongated base, said base having a front surface, a rear surface, a top end, and a bottom end, a pair of hooks, including a top hook and a bottom hook, said hooks secured to the base top surface, and at least one U-shaped guide having a guide top, the guide positioned horizontally between the hooks creating a space between the guide and the base top surface;

a rope assembly, the rope assembly for extending from the toilet seat to the plate assembly for controlling positioning of the toilet seat, said rope assembly comprising a rope having two ends and a loop between the ends, and a pair of clamps wherein each clamp is attached to one of the ends of the rope, said clamps secured around the toilet seat ring, wherein the rope loop extends under the guide and is selectively looped around the top hook when the toilet seat is in the lowered position, and to raise the seat the loop is selectively removed from the top hook and is pulled downward over the guide top toward the bottom hook to raise the toilet seat and looped around the bottom hook to maintain the toilet seat in the raised position.

2. The toilet seat lifting device as recited in claim 1, wherein the top hook is positioned at the top end of the base and is oriented upward, and the bottom hook is positioned at the bottom end of the base and is oriented downward.

3. The toilet seat lifting device as recited in claim 2, wherein the rope assembly clamps are positionable on opposite sides of the toilet seat ring, the toilet seat ring having a top surface and a bottom surface, each clamp being C-shaped and having a clamp top, clamp sides, a pair of clamp ends and an opening between the clamp ends, wherein the clamp is flexible so that the opening may be made larger by spreading the ends apart to enabling the clamp to extend around the toilet seat ring with the clamp top resting on the toilet seat top surface and the clamp opening beneath the toilet seat bottom surface.

4. The toilet seat lifting device as recited in claim 3, wherein the U-shaped guides extend horizontally across the base front surface and are attached thereto.

5. A method of lowering and lifting a toilet seat for use with a toilet having the toilet seat, the toilet seat having a toilet seat ring having a top surface, and a bottom surface, using a toilet seat lifting device having a rope assembly and a plate assembly, the rope assembly having a rope and a pair of clamps, the rope having two ends and a rope loop therebetween, each clamp attached to one of the rope ends, and the plate assembly having a base, a top hook, a bottom hook, and at least one guide extending across the plate and creating a space between the plate and guide, the guide located between the hooks, comprising the steps of:

mounting the plate to a wall surface above the toilet;

securing the clamps to the toilet seat by extending the clamp onto opposite sides of the toilet seat ring;

extending the rope loop between the guide and plate toward the top hook;

lifting the toilet seat by looping the rope loop around the bottom hook; and lowering the toilet seat by looping the rope loop around the top hook.

6. The method of lifting the toilet seat as recited in claim 5, wherein each guide has a guide top, the step of lifting the toilet seat by looping the rope loop around the bottom hook further comprises the steps of:

unhooking the rope loop from the top hook;

folding the rope over the top surface of the guides; and pulling the rope loop downward toward the bottom hook.

7. The method of lifting the toilet seat as recited in claim 6, further comprising the step of maintaining the toilet seat in the lifted position by looping the rope loop around the bottom hook.

* * * * *